United States Patent [19]

Grant et al.

[11] 4,045,022

[45] Aug. 30, 1977

[54] NO-LINE TENNIS COURT

[76] Inventors: Geoffrey F. Grant, La Jolla; Robert W. Nicks, Del Mar, both of Calif.

[21] Appl. No.: 570,727

[22] Filed: Apr. 23, 1975

[51] Int. Cl.[2] ..... A63B 61/00

[52] U.S. Cl. ..... 273/29 R; 272/3

[58] Field of Search ..... 272/3; 273/29 R, 55, 273/31, 3, 55 R, 1.5 R

[56] References Cited

U.S. PATENT DOCUMENTS

| | | | |
|---|---|---|---|
| 438,962 | 10/1890 | Thornton | 273/126 R |
| 1,528,632 | 3/1925 | Richards | 272/3 |
| 2,205,398 | 6/1940 | Eaton | 273/29 R |
| 3,415,517 | 12/1968 | Krist | 273/29 R |
| 3,580,573 | 5/1971 | Noonan | 273/55 R |

*Primary Examiner*—Anton O. Oechsle
*Assistant Examiner*—T. Brown

[57] ABSTRACT

A tennis court wherein the different playing zones thereof defined by the rules of tennis are distinguished by color, as opposed to the conventional use of white stripes to define zone boundaries.

4 Claims, 4 Drawing Figures

NO-LINE TENNIS COURT

BACKGROUND OF THE INVENTION

The present invention relates to a zone-defining scheme for the surface of a tennis court.

In the prior art, the surfaces, the playing area of tennis courts are one color, the definition of the various playing zones recited in tennis rules being accomplished by white stripes on the court surface. With the development of electronic monotoring systems to call balls (one of such systems being the subject of a copending application filed by applicant), difficulties have been encountered with the stripe system of zone definition, particularly at the boundary between the left and right serve-receiving zones at which a ball landing on the center stripe is considered in bounds for both zones. Further research revealed that at all boundary lines marked with a stripe, the difficulty of judging the exact point of impact by eye was exacerbated by the presence of the stripe.

SUMMARY OF THE INVENTION

As a result of experimentation directed toward solving the abovementioned problems, the tennis court of the present invention was developed, this court having no stripes at all on the playing surface. Instead, contiguous zones are colored differently so that unidimensional boundary lines are discernable along the lines of color discontinuities. As implied above, not only is the problem of overlapping serve-receiving zones thus eliminated, but an unanticipated advantage is provided in the greatly improved ability of the players and spectators to correctly judge in which zone the ball lands, this advantage apparently stemming from the elimination of the visual confusion, or illusion, encountered when a rapidly moving object darts across two closely spaced lines represented by the edges of the white stripes.

DETAILED DESCRIPTION OF THE PREFERRED EMBODIMENT

Figure 1:
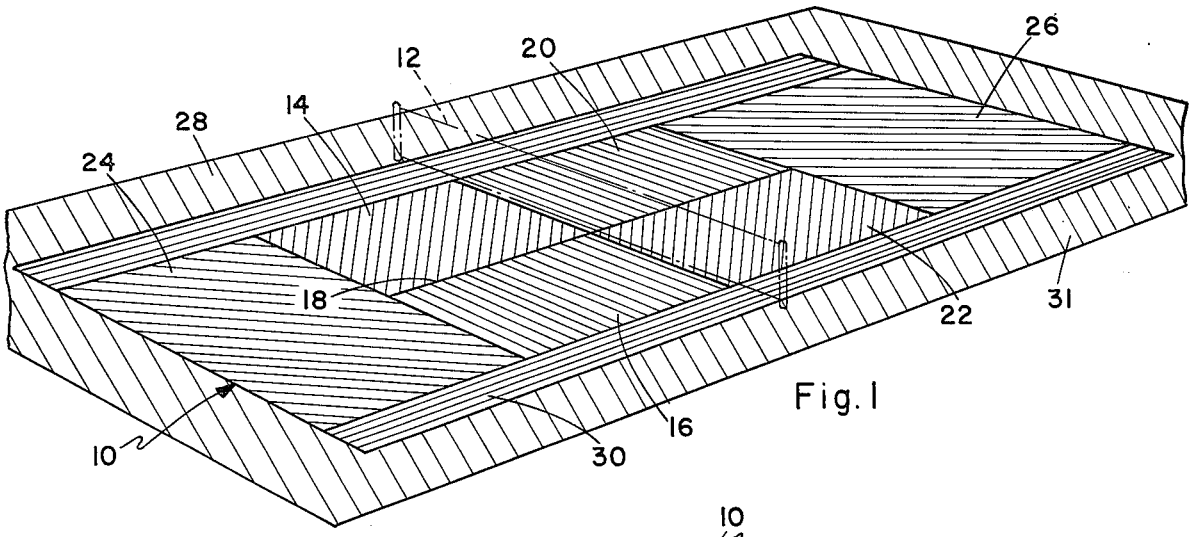
FIG. 1 is a perspective view of the tennis court, showing the distinctive coloring.

A tennis court 10 having a net 12 and the zone defining scheme of the invention is shown in FIG. 1, in which the different playing zones are shaded to indicate one possible system of coloration. It is of course necessary, if the coloring arrangement is to completely replace the stripes that each zone be colored differently from all contiguous zones (words "contiguous zones" as used herein are defined to mean two zones sharing a common boundary, rather than a common point, so that diagonal serve-receiving zones would not be contiguous). In the arrangement shown, the near serve-receiving zones 14 and 16 are pigmented or colored differently to efine a single unidimensional boundary line 18, and similarly serve-receiving zones 20 and 22 are differently colored. In order that the court have the identical appearance from both sides of the net, the coloring may be symmetrical about the center point of the court, so that diagonally relates zones 14 and 22 are the same color, as are the zones 16 and 20. Following this concept, the end play zones 24 and 26 can be identically colored as well as the two doubles zones 28 and 30. Therefore, with a minimum of four different colors, each zone is distinguishable from every contiguous zone, and both halves of the court appear the same when viewed from the other side of the net. This symmetry is not absolutely necessary and may even be undesirable in some circumstances. Of course, the out-of-bounds zone 31 surrounding the court proper (the playing area) should be of a different color than any of the playing zones with which it is contiguous.

Figure 2:
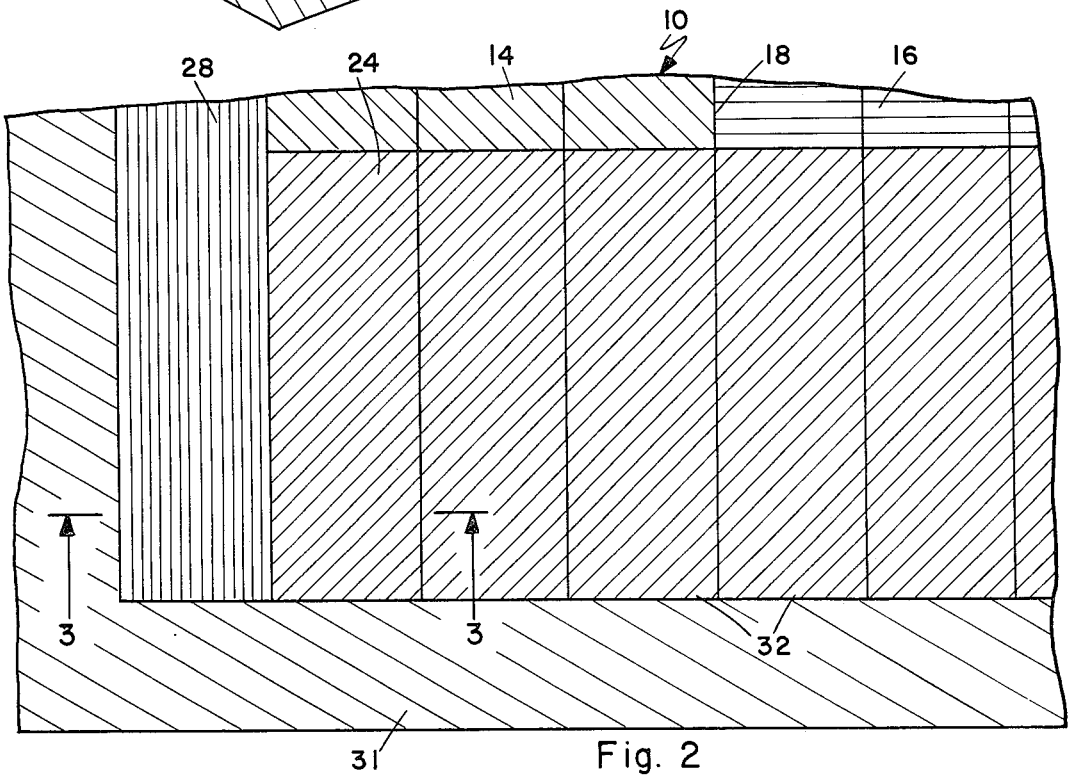
FIG. 2 is an enlarged top plan view of a portion of the court.

In FIG. 2, the court surface can be seen to be defined by a number of strips of matting 32, which can be manufactured in the desired colors and unrolled on the court. The use of matting would of course eliminate the need to paint or otherwise color the court directly, and the mats could be transported to different courts.

Figure 3:
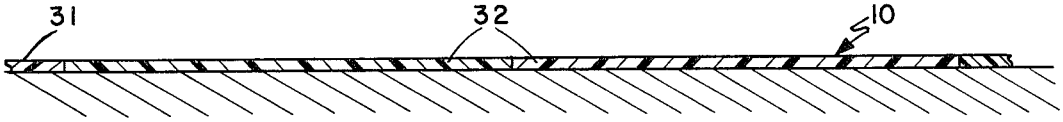
FIG. 3 is an enlarged sectional view taken on line 3—3 of FIG. 2.
Figure 4:
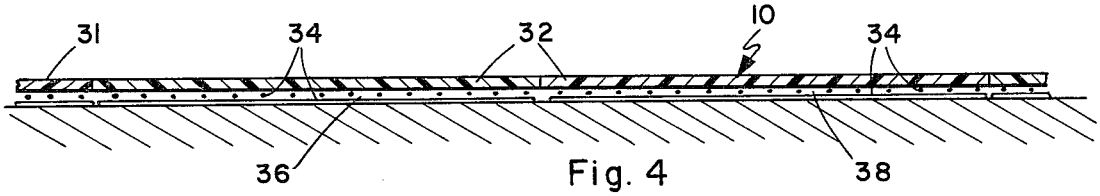
FIG. 4 is a similar sectional view showing the addition of conductive mesh panels under the court.

FIG. 3 discloses diagrammatically part of an automatic ball sensing apparatus implemented by the colored surface which constitutes another invention of applicant for which a patent will be applied. In this system, modular sensing mats are disposed beneath the surface mats 32, each of these sensor mats corresponding to a particular playing zone and comprising basically an insulated grid of crosswire 34. One of these grids, shown at 36, lies beneath zone 28, and the other grid 38 lies beneath zone 24, there of course being other similar grids provided for the other zones. This gridwork could be built directly into the tennis court surface beneath the painted surface rather than provided as a separate mat.

Clearly the surface of the tennis court as illustrated in FIG. 1 could be colored with paint, or by using naturally colored or pigmented construction material, but for the purposes of uniformity in the claims, the term "pigmented" has been used throughout without the intention of limiting the means by the court surface is colored.

An exibition match has been played on a court constructed according to this invention before the officials and some of the players of the World Team Tennis Organization, and the court was received with enthusiasm. Everyone involved in the match, including referees, linemen, spectators, and the players themselves, found the colored court not only aesthetically appealing, but of tremendous advantage in correctly judging balls due to the effect of the contiguous color scheme on the human visual physiology. Any referee who has called balls on a striped court will testify to the high frequency of errors in calling close shots, and with the increasing interest being generated by tennis, the stakes in matches have jumped considerably and the players are of such quality that a great number of shots during these matches fall within a marginal area of a zone line where judging becomes difficult. As the players are usually closely matched in ability, it is not at all infrequent that just one erroneous call, or an aggregation of such calls, results in the winning player being judged the loser, sometimes being eliminated from further competition in the match, and invaribly losing prize money that may amount to many thousands of dollars. From this perspective the importance of the present invention in permitting more accuraate line calls to be made can be fully appreciated.

We claim:

1. A tennis court for playing singles or doubles tennis in which stripes between zones have been eliminated thereby eliminating two closely spaced lines on opposite edges of the stripes, said court comprising a playing surface;

a net dividing said playing surface into a fore court and a far court; said fore court comprising a pair of quadrilaterally shaped near serving zones of different colors abutted to define a boundary line therebetween, said boundary line being defined only by the zone of one near receiving court being a first color and said other near serving zone being of a different color, an end play zone of a different color than said near serve-receiving zones and defining a laterally extending boundary line by the differences in colors between said end play zone and each of said near serving zones, and an end out of bounds zone of a different color than the color of said end play zone and said colors meeting and defining a laterally extending out of bounds boundary line for said near court; said far court comprising a pair of quadrilaterally shaped far serving zones each of different colors and abutted to define a boundary line therebetween only by the differences in colors therebetween, an end play zone of a different color than either of said far serve-receiving zones and defining a laterally extending boundary by the differences in colors between said end play zone and each of said far serving zones, and an end out of bound zone of a different color than the color of said end play zone and said colors meeting and defining therebetween a laterally extending out of bounds boundary line for said far court; a pair of double zones each having a color different than said near court end zone and said far court end zone and different than its abutted serve receiving zones, said colors of said doubles zones and said end zones and abutting serve-receiving zones defining the interior boundary lines for said doubles zones; and a pair of side out of bound zones extending fore and aft along said outer edges of said double zones and being of a different color than its adjacent doubles zones and meeting and defining by said differences in colors the outer side boundaries of said doubles zone.

2. A tennis court in accordance with claim 1 in which said diagonally related serving zones are of the same color and said near and far end zones are of the same color.

3. A tennis court in accordance with claim 1 in which all of the out of bounds zones are of the same color and in which the colors of the other zones are symmetrical about the center of the tennis court.

4. A tennis court in accordance with claim 1 in which at least a minimum of four different colors are used for said zones.

* * * * *